United States Patent [19]

Chung

[11] Patent Number: 4,927,352

[45] Date of Patent: May 22, 1990

[54] BOILER FURNACE AIR REGISTER

[76] Inventor: Landy Chung, 5144 Cliff Dr., Ashtabula, Ohio 44004

[21] Appl. No.: 221,134

[22] Filed: Jul. 19, 1988

[51] Int. Cl.[5] ..... F23M 9/00

[52] U.S. Cl. ..... 431/184; 239/402.5; 239/405

[58] Field of Search ..... 431/182, 183, 184; 239/402.5, 403, 405, 416.5; 98/110

[56] References Cited

U.S. PATENT DOCUMENTS

| | | | |
|---|---|---|---|
| 1,527,214 | 2/1925 | Peabody . | |
| 1,628,424 | 5/1927 | Peabody . | |
| 2,320,576 | 6/1943 | Dunn . | |
| 2,838,103 | 6/1958 | Voorheis . | |
| 3,145,670 | 8/1964 | Copian et al. | 431/184 |
| 3,743,471 | 7/1973 | Jaeger . | |
| 3,944,142 | 3/1976 | Welden et al. . | |
| 4,504,216 | 3/1985 | Hagar et al. . | |
| 4,681,532 | 7/1987 | Chung . | |

FOREIGN PATENT DOCUMENTS

| | | | |
|---|---|---|---|
| 233901 | 1/1960 | Australia | 431/184 |
| 339844 | 8/1921 | Fed. Rep. of Germany | 431/184 |
| 958907 | 5/1964 | United Kingdom | 431/184 |

OTHER PUBLICATIONS

Publication entitled "Large Burners and Low $NO_X$", distributed by the Foster-Wheeler Energy Corporation and bears a copyright date of 1979.

Foster Wheeler "Experience in $No_x$ Emissions on Operating Steam Generators", Published Nov. 8 & 9, 1978, Hoel Vatsky, Supervisor.

EPRI Journal, Published Nov. 1984 by Electric Power Research Institute, Inc. *pp. 26 through 33*.

*Primary Examiner*—Randall L. Green

*Attorney, Agent, or Firm*—Watts, Hoffmann, Fisher & Heinke Co.

[57] ABSTRACT

A dual register for controlling the flow of combustion air to a burner including an outer register formed by a mounting frame having spaced apart support plates interconnected by circumferentially spaced fixed housing members. The frame defines a plurality of inlet openings for admitting a first stream of air substantially radially from a wind box. Each inlet opening includes at least one, non-planar, oblique parallelogram shaped curved damper door for controlling the admission of combustion air into an inner region of the outer register; each damper door is configured to impart a rotational component to the first stream of air while urging it axially towards a burner region. A connector for connecting the register to the combustion air region includes a plurality of apertures for communicating a second stream of air from the wind box to an outlet region of the register. The second stream of air inhibits the development of undesirable flow patterns in the first stream of air as the first stream leaves the register. An inner register assembly provides a third stream of air for the burner that flows substantially axially from an axial inlet opening to the burner region. A seal comprising a plurality of overlapping, radial sealing members for providing a sealing interface between the register and a fuel pipe assembly extending through the register.

21 Claims, 8 Drawing Sheets

BOILER FURNACE AIR REGISTER

TECHNICAL FIELD

The present invention relates in general to air registers for furnaces and boilers and, in particular, to air registers designed to admit and to regulate air necessary to support combustion in industrial furnaces and boilers. Specifically, the invention relates to air registers used with coal, oil or gas fired steam generating boilers.

BACKGROUND ART

Air registers per se, are well known by those skilled in the art and air registers designed to regulate more than one source of combustion air are also well known. Thus, the prior art is replete with disclosures of air registers referring to so-called primary, secondary and even tertiary combustion air and various means to deliver this air to a boiler. Although each inventor of air registers defines and refers to combustion air in accordance with his own background and concepts, combustion air usually falls into two broad categories. Primary air is generally understood to refer to air which is used as a carrier medium to transport the fuel to the furnace. Powdered coal is a good example of a fuel which is transported in a stream of air through a separate fuel pipe. Since transport air only supplies about 18% of the air needed for full combustion, an additional supply of air must be brought into the boiler from another source and by another means. This "make up" air is sometimes called "secondary air", and is supplied in sufficient volume to provide the additional 82% of required air. However, if a boiler is oil or gas fired, usually little or no supplemental means are required to transport these fuels since they are generally self-transporting. Thus, substantially 100% of the combustion air must be supplied from some source. Whether air from this source is labeled primary or secondary is a matter of semantics. It is obvious that the source of air supplied through a given register in a powdered coal burning boiler might be referred to as "secondary". On the other hand, a source of air supplied through the same register for use in the same boiler while being operated on oil might be referred to as primary air. In the alternative, the source of air through the air register may be called secondary irrespective of whether the boiler is being coal fired, oil fired or gas fired. One fact is indisputable, the function of the air remains the same irrespective of its label.

For many years a so-called "daisy chain" type damper air register was widely used in the energy generating industry. Examples of this type of register are shown in U.S. Pat. Nos. 2,320,576 and 2,838,103. The dampers for this type of register were positioned immediately adjacent to the throat of the boiler and the complex damper operating mechanism known as a daisy chain has a history of high incidence of failure due to overheating. After a short period of operation the daisy chain linkage would freeze, rendering the dampers inoperable. Thus, operators were afraid to close the dampers during the firing of a boiler because of the high probability that they would freeze in the closed position, thereby rendering the air register inoperable. As a consequence, the daisy chain dampers were usually left wide open at all times, which rendered the register useless as a means of obtaining and controlling efficient fuel combustion.

DISCLOSURE OF THE INVENTION

The present invention provides a new and improved air register for controlling and delivering combustion air to a burner such as used with a boiler. The disclosed air register is operative to control the flow rate of at least one stream of air as well as its flow characteristics.

According to the invention, the air register includes a peripherally mounted damper door arrangement which defines a variable inlet to the register. In particular, the arrangement includes a plurality of damper doors each of which is movable between a substantially closed to substantially opened position. When opened, the doors expose radial openings defined by the register structure through which air is admitted into the register.

According to a feature of this embodiment, each damper door is configured as a curved, oblique parallelogram and is rotatable about an axis that lies substantially along a diagonal of the parallelogram, when the door is viewed in plan. When mounted, the axes of rotation for the damper doors are parallel and axially oriented with respect to a centerline of the overall air register.

With the disclosed damper door configuration, as the damper doors open partially, the shape and curvature of the damper doors imparts rotation and axial thrust to the air as it enters the air register. When the damper doors are in an initial opening range, the spin force imparted to the air entering the air register is high. Since air turbulence can increase $NO_X$ emissions, a turbulence control member is mounted downstream of the air register damper doors and tends to reduce the turbulence of the air. In the preferred and illustrated embodiment, the turbulence control member comprises a ring disposed near an outlet of the register that mounts a plurality of air deflection blades that extend radially inwardly with respect to the centerline of the register.

In accordance with this feature of the invention, once the damper doors open substantially fully, the turbulence imparted to the incoming air is substantially reduced. For this reason, the inwardly directed air deflection blades extend only partially into the flow path and have a substantial effect only when air is traveling under high turbulence through the air register.

In accordance with the invention, the damper doors are mechanically linked so that a single control member opens and closes the damper doors in unison. With this arrangement, the flow of the incoming air can be easily and continuously adjusted while still controlling $NO_X$ and other emissions. The control also allows the burner to be adjusted quickly in response to changes in boiler demand or changes in combustion and/or fuel characteristics. The disclosed air register is mechanically reliable, is easily installed and easily maintained while providing improved combustion control as compared to other available air registers.

According to another embodiment of the invention, the air register includes an inner register assembly mounted within an outer register, the outer register being of the configuration described above. The inner register defines an axial flow path commencing at axial ports defined by the inner air register assembly. Air entering each axial port is controlled by an associated damper which in the preferred embodiment is supported for rotation on a radially directed shaft. Operating linkage interconnects the axial damper doors so that the doors can be opened and closed in unison. In this embodiment, a funnel-like air guide is mounted centrally within the outer register assembly and defines a tubular flow path for the axial air stream travelling through the inner register. A fuel pipe, which carries a stream of pulverized coal or other fuel, extends centrally through the register and in particular extends through the funnel shaped air guide.

With this disclosed embodiment, precise burner control can be achieved. The axial air stream provided by the inner register can be used to control the flame shape and configuration. It is believed that the axial air stream envelops the flame to provide $NO_X$ control. The inner register, it is believed, provides a laminar flow stream between the fuel and combustion air (supplied by the outer register). This air stream can be used to control flame size, shape, length, temperature and fuel ignition point.

According to a feature of the invention, the turbulence control member is used to interconnect the register assembly with the furnace opening. The control ring described above comprises a tapered connector that mounts the air deflection blades or vanes. The blades extend radially from the inside of the ring. A series of air leakage holes are spatially located in the tapered connector, downstream of the turbulence control blades. Air admitted through the leakage holes exerts a force on air traveling through the connector and tends to counteract any tendency for reverse air flow, such as eddy current flows, generated as the air enters the combustion region of the boiler.

The disclosed invention provides an air register that is capable of precise combustion control while reducing and/or controlling pollution emissions such as CO and $NO_X$. This is accomplished without sacrificing reliability or maintainability of the hardware.

Additional features of the invention will become apparent and a fuller understanding obtained by reading the following detailed description made in connection with the accompanying drawings.

BEST MODE FOR CARRYING OUT INVENTION

Figure 1:
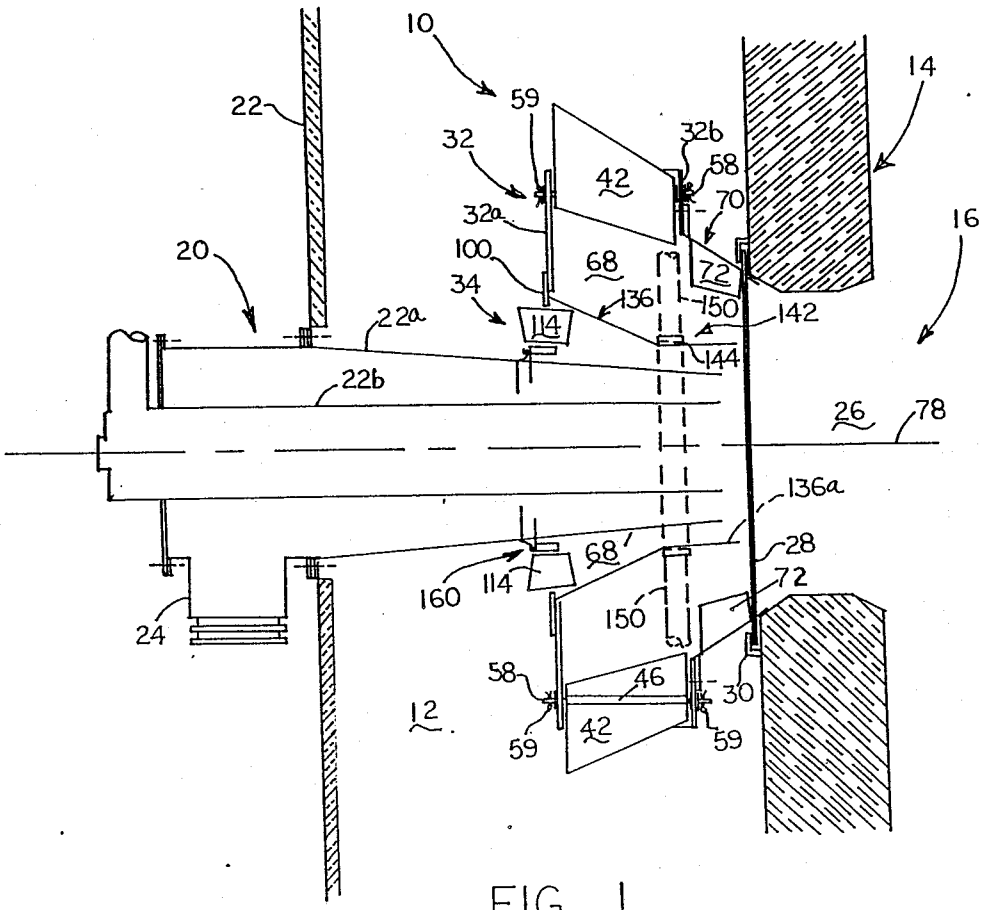
FIG. 1 is a sectional view of an air register, illustrated somewhat schematically, constructed in accordance with the preferred embodiment of the invention, shown mounted to a boiler.
Figure 3:
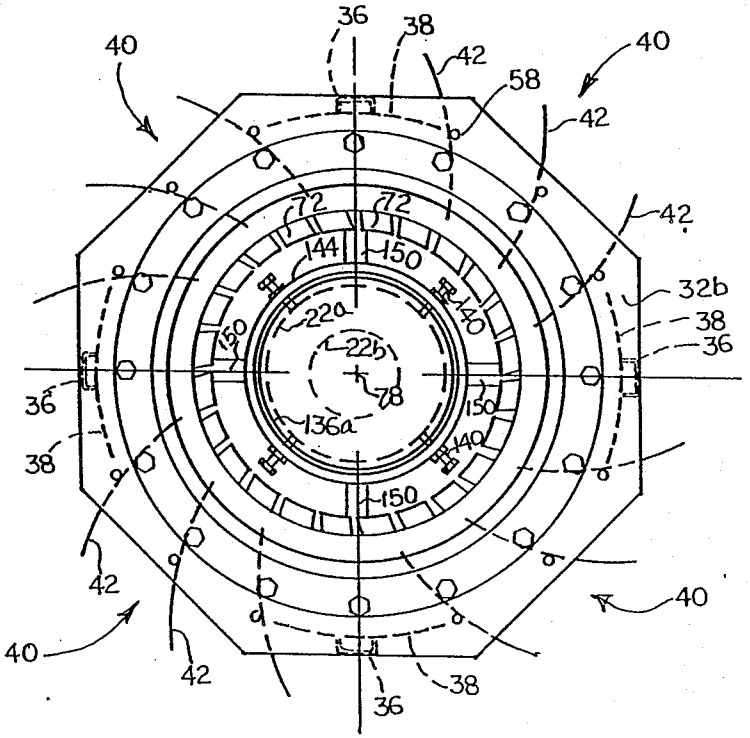
FIG. 3 is a front elevational view as seen from the plane indicated by the line 3—3 in FIG. 2.
Figure 2:
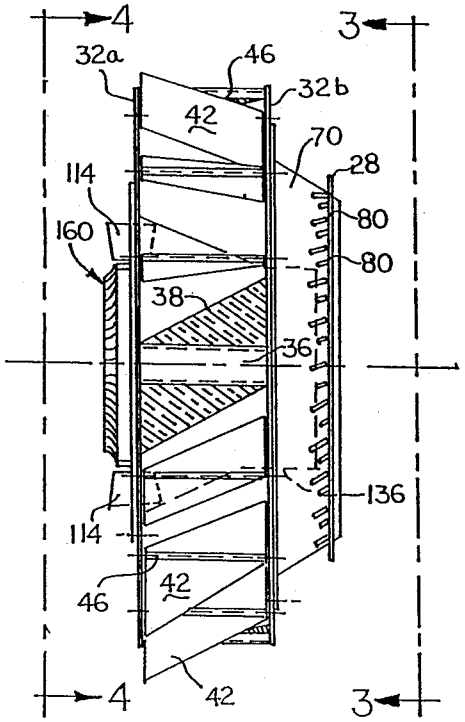
FIG. 2 is a side, elevational view of an air register constructed in accordance with a preferred embodiment of the invention.

FIG. 1 shows an air register assembly, constructed in accordance with the preferred embodiment of the invention. The air register assembly 10 is shown mounted within a "wind box" 12 and connected to a boiler wall 14 in alignment with a burner opening 16 defined in the wall. A fuel pipe assembly 20 extends from outside an external wind box wall 22. In the disclosed arrangement, the fuel pipe assembly 20 includes outer fuel pipe **22*a* that surrounds and is axially aligned with an inner air or fuel pipe 22*b*. The outer fuel pipe 22*a* delivers air and fuel to the combustion zone indicated generally by the reference character 26. The fuel may comprise pulverized coal which is received by the fuel pipe 22*a* by way of an inlet 24. In this type of arrangement, an oil burner (not shown) may be mounted in the inner pipe 22*b*. The burner assembly may burn coal or oil or combinations depending on the application and/or boiler conditions. The fuel pipe assembly 20** is considered conventional and does not form part of the present invention.

The air register 10 is attached to the boiler wall 14 in a conventional manner and may for example include an annular mounting plate 28 clamped to the wall by clamp structure 30.

As is known, a source of heated air under pressure is supplied to the wind box 12. In general, the wind box surrounds a plurality of air registers 10 (only one is shown) and provides a common source of combustion air for all of the air registers and hence the burners associated with the air registers.

The embodiment of the invention shown in FIG. 1 is characterized as a "dual register" in that it comprises an outer register indicated generally by the reference character 32 and an inner register indicated generally by the reference character 34.

Referring also to FIGS. 2–6, the outer register 32 is fabricated from a pair of spaced apart, octagonally-shaped, support plates **32*a*, 32*b*, interconnected by support channels 36, spaced 90 degrees apart. The support plates 32*a*, 32*b* in conjunction with the channel members 36** are welded together and together form a rigid frame for the outer register.

Curved, oblique parallelogram-shaped fixed housing members 38 (shown best in FIGS. 2 and 6) are welded between the support plates **32*a*, 32*b* just below each channel member 36. The housing members 38 define four radial openings, indicated generally by the reference character 40** through which combustion air is admitted into the outer register.

A plurality of outer damper doors 42, preferably three (3), are movably mounted in each opening 40 and are opened or closed to control the amount of air admitted through their associated inlet opening 40.

Figure 11:
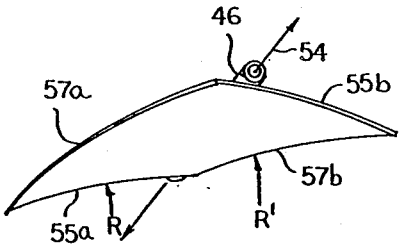
FIG. 11 is a perspective view of the damper door shown in FIG. 9.
Figure 10:
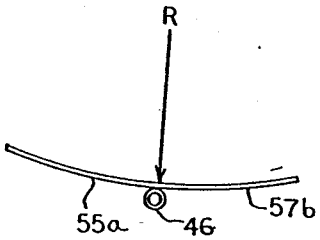
FIG. 10 is an end view of the damper door as seen from the plane indicated by the line 10—10 in FIG. 9.
Figure 9:
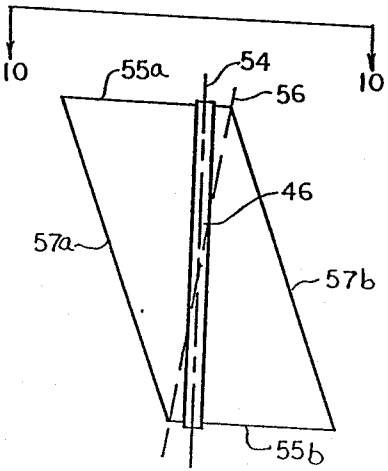
FIG. 9 is a side elevational view of a damper door forming part of the air register.
Figure 13:
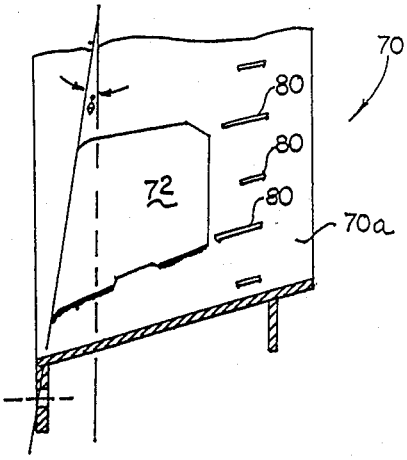
FIG. 13 is a fragmentary view of the turbulence control member.
Figure 14:
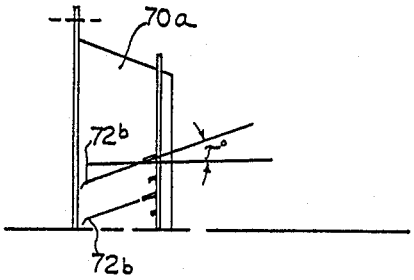
FIG. 14 is a side, fragmentary view of the turbulence control member.
Figure 15:
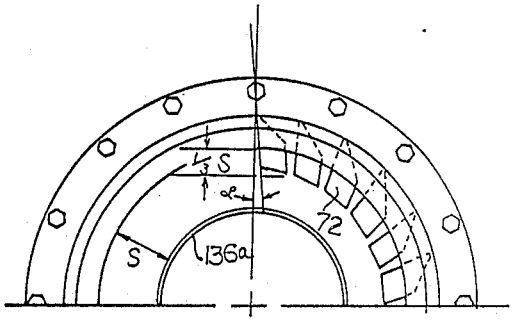
FIG. 15 is a fragmentary, end view of the turbulence control member.

Referring also to FIGS. 9–11, each outer damper door 42, as viewed in plan, is configured as an oblique-parallelogram.

As seen best in FIG. 9, a pivot tube 46 is fixed, as by welding, to the outside of each damper door. In the preferred and illustrated embodiment, it extends somewhat diagonally across the damper door 42. However, it is positioned such that an axis 54 defined by the pivot tube 46 crosses a diagonal line 56 of the door. The axis 54 is substantially orthogonal to side edges (when viewed in plan) 55*a*, 55*b* and defines an oblique angle with respect to angled side edges 57*a*, 57*b*. As seen in FIG. 10, the damper door 42 has a radius of curvature R when viewed from the edge 55*a* such that when the three doors 42 of a given inlet opening 40 are closed, a substantially cylindrical surface is defined that extends between the fixed housing members 38.

According to this feature the side edges 55*a*, 55*b* have the same radius R and the leading and trailing edges 56*a*, 56*b* have the same radius R' which is different from the radius R. This damper door configuration operates to impart rotational forces to the incoming air to produce rotation in the air streams entering the register through the inlet openings 40 while at the same time imparting an axial thrust to the air streams urging them towards the combustion zone 26.

As seen best in FIG. 1, a pivot pin 58 extends between the mounting plates 32*a*, 32*b* and pivotally supports each damper door. Cotter pins 59 may be employed to maintain the position of the pivot pins.

Figure 5:
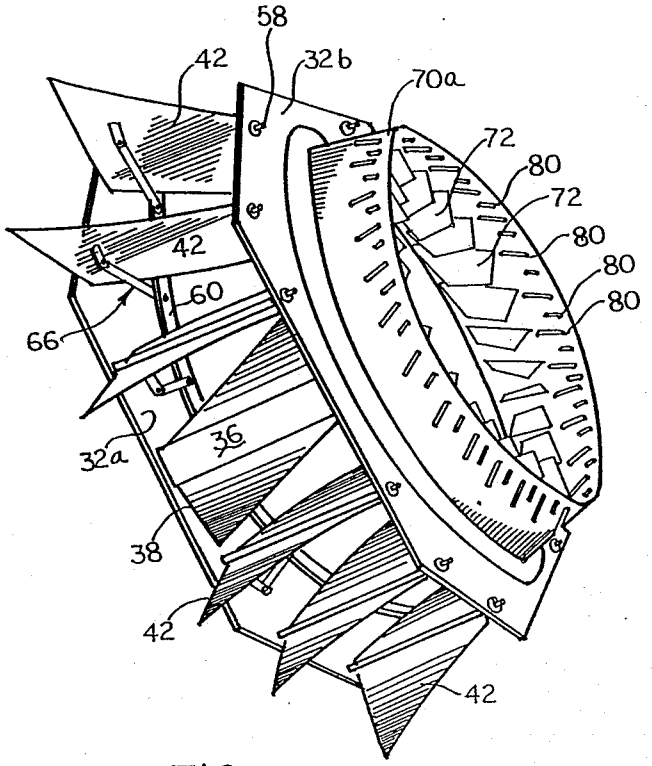
FIG. 5 is a perspective view of the air register.
Figure 4:
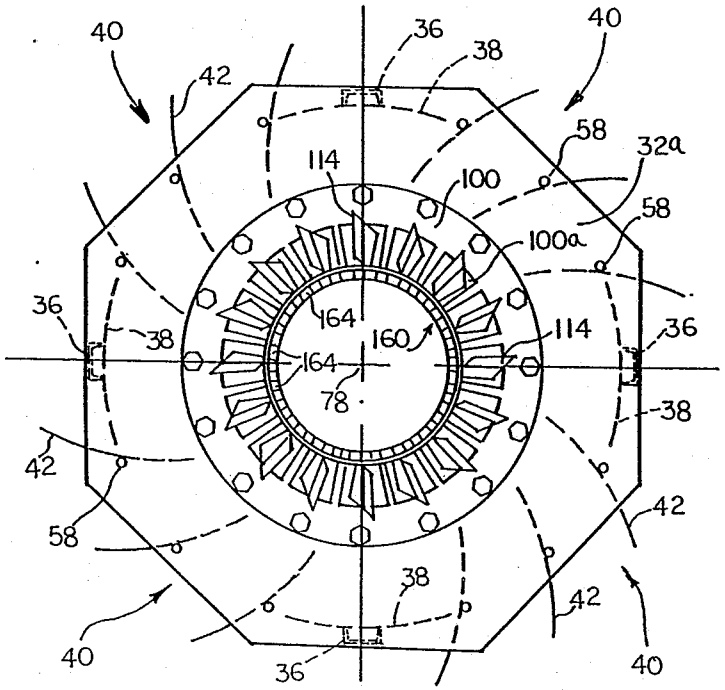
FIG. 4 is a rear elevational view as seen from the plane indicated by the line 4—4 in FIG. 2.
Figure 6:
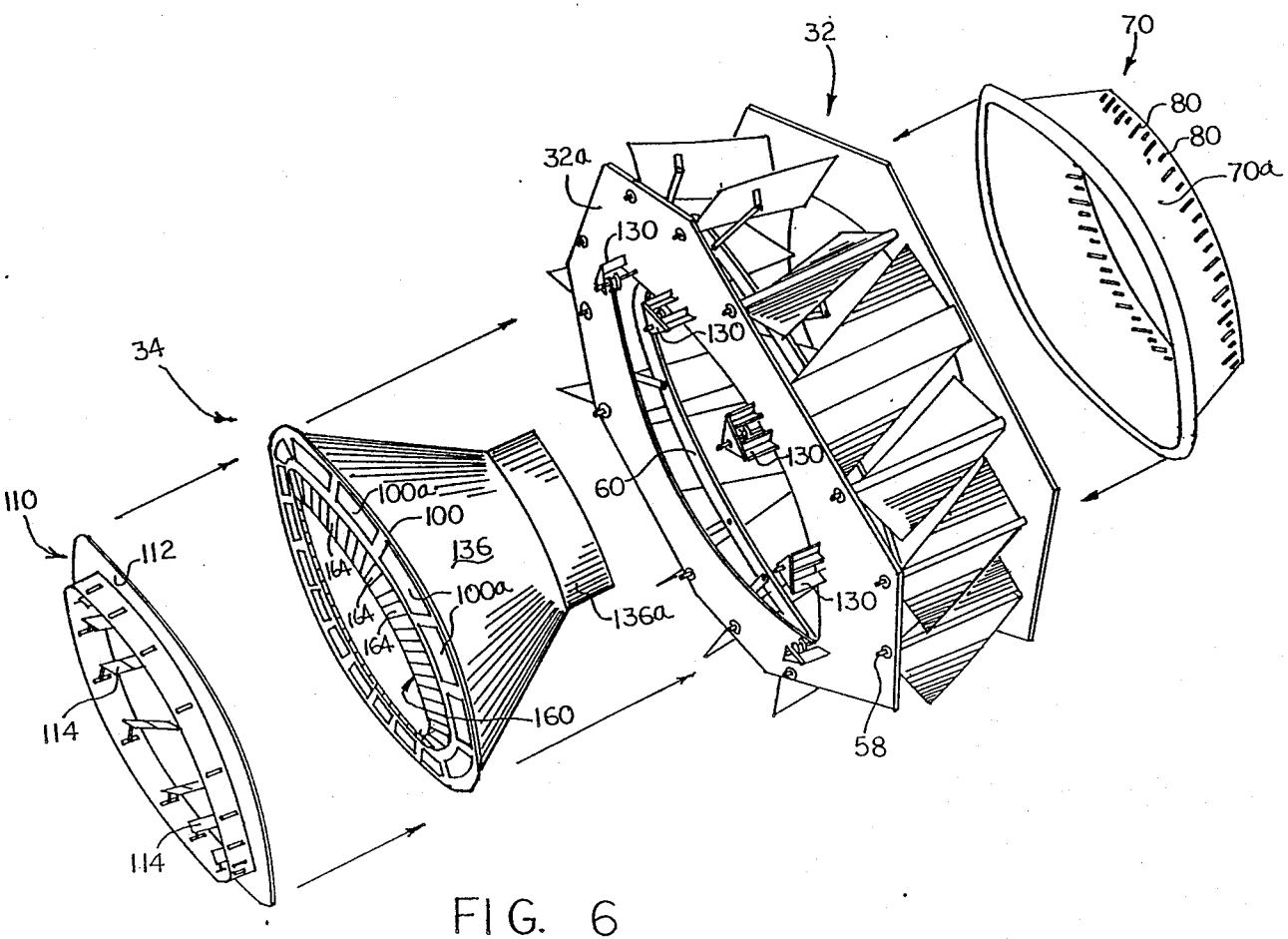
FIG. 6 is an exploded view of the air register.
Figure 8:
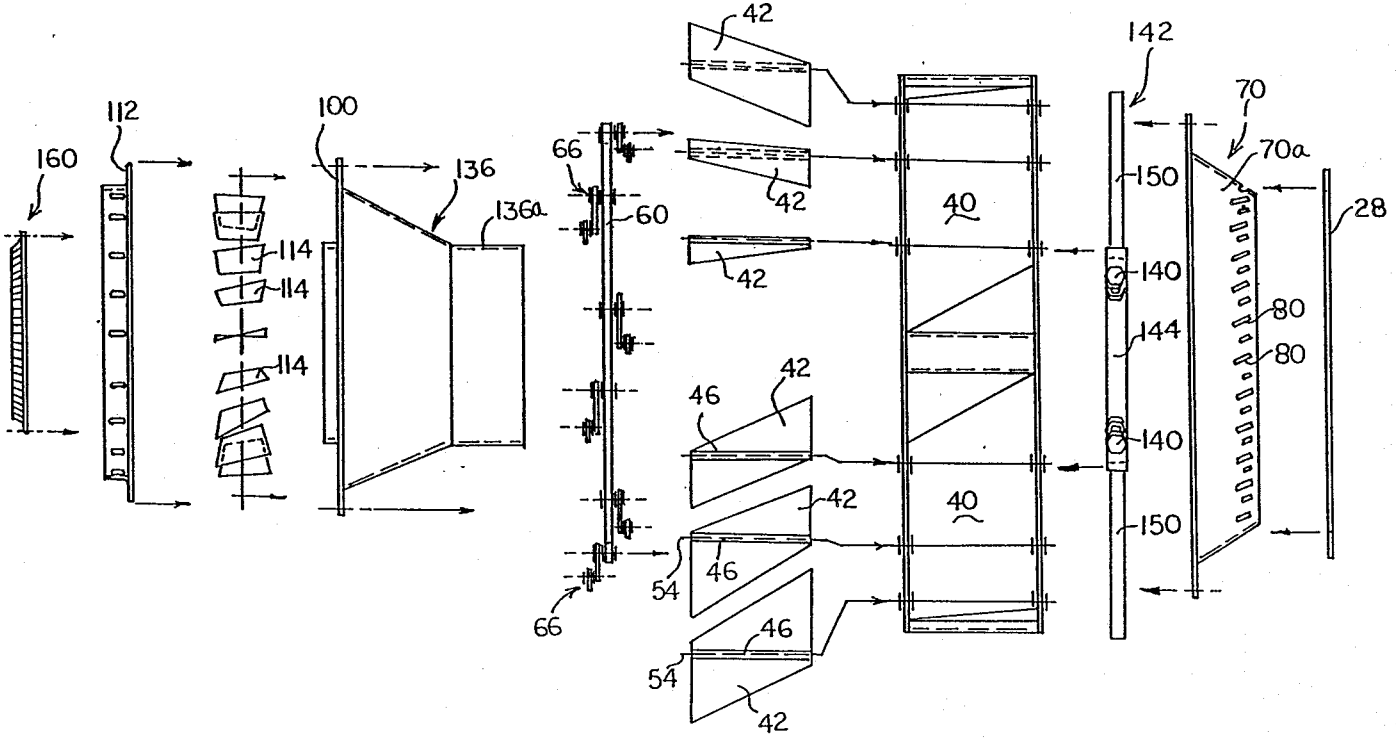
FIG. 8 is another exploded view of the air register.

As seen best in FIGS. 5, 6 and 8, an actuating ring 60 mounted within the outer register is interconnected with each door by a crank mechanism 66. With this arrangement, rotation of the control ring 60 causes the outer damper doors 42 to open and close in unison. Movement in the control ring can be achieved through known linkages (not shown) which would enable the ring to be moved by a control that is external to the wind box 12.

Referring to FIG. 1, combustion air admitted through the radial openings 40 enters an inner region 68 of the outer register. Due to the shape and curvature of the outer damper doors 42, a spinning motion as well as an axial thrust is imparted to the air which causes the incoming air to rotate and move axially towards the burner opening 16. The degree or amount of rotation imparted to the incoming air is at least in part a function of the degree of damper door opening. When the doors are only partly open, i.e., less than 50%, substantially high rotation forces are imparted to the air stream. Since it has been found that high turbulence is not conducive to low $NO_X$ emissions, a turbulence control member 70 is provided which interconnects the outer register 32 with the boiler wall 14. The turbulence control member 70, in the preferred and illustrated embodiment, comprises a tapered connector-like member 70*a*.

Figure 12:
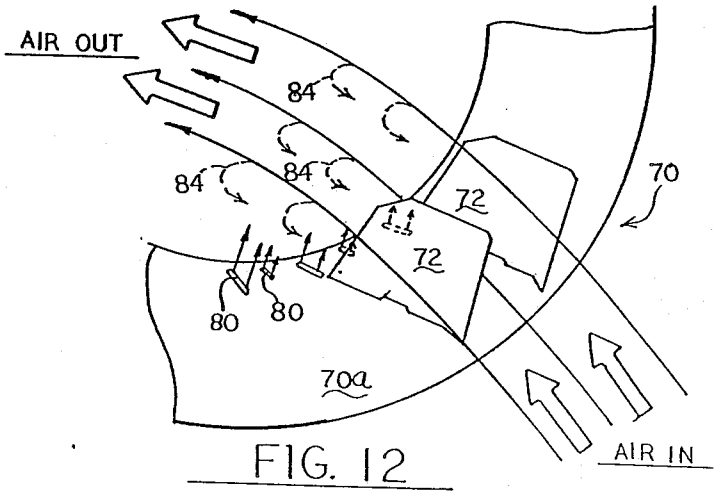
FIG. 12 is a fragmentary view of a turbulence control member forming part of the air register.

A plurality of inwardly directed, angled air deflection blades or vanes 72 are mounted to the inside of the ring 70*a* (as seen best in FIG. 12). Referring also to FIGS. 12–15, it is believed that blades 72 having the following configuration parameters and mounting parameters provide satisfactory results. Each blade 72 should have a radiused portion 72*b* (see FIG. 14) defining an angle theta ($\theta$ (shown in FIG. 13) of approximately 27 degrees. Each blade 72 should define a mounting angle tau ($\tau$) with respect to the axis of the register that is in the range of 31 to 35 degrees and should be tilted with respect to the radial direction by an angle lambda ($\lambda$) that is in the range of 2 to 6 degrees.

In the preferred embodiment, the radial extent of each blade is no more than $\frac{1}{3}$ of an effective outlet diameter S of the connector 70*a*. The blades are shaped, sized and curved to reduce turbulence in the air for small openings of the damper doors 42. It is believed that when the doors are fully open, turbulence is substantially reduced and the blades have minimal effect on the air flow since they do not extend through a major portion of the outlet of the air register. When the doors are only partially opened i.e. less than 50%, the air admitted into the register is directed toward the inner periphery (spaced from a centerline 78 of the register). Under these operating conditions the blades 72 are effective to counteract the rotation imparted by the doors.

As seen best in FIG. 12, to further control the air stream, air leakage holes 80 are formed in the connector 70*a*, downstream of the blades 72. As the air stream leaves the connector 70 and enters the boiler, eddy currents (shown in phantom and indicated by the reference character 84) form. Air injected into the airstream by way of the leakage holes 80 tends to counteract the eddy currents to provide a smoother air stream.

With the disclosed register construction, precise combustion air control can be realized. The outer damper doors 42 can be used to precisely control the amount of combustion air admitted to the burner area while at the same time functioning to produce controlled rotation in the air stream so that complete intermixing with the fuel discharged by the fuel pipe assembly 20 can be realized. This is accomplished without sacrificing emission control. The disclosed register is capable of operating with substantially low $NO_X$ emissions as compared to prior art daisy chain type registers and other types as well.

As indicated above, in the illustrated embodiment, the disclosed air register is of the "dual register configuration". The register assembly described above would be characterized as the outer register and admits combustion air radially into the unit and redirects the air stream axially, with a rotation component, towards the burner. The "outer register" assembly described above may be used by itself in certain applications if the functions provided by the inner register are not needed.

As seen best in FIG. 6, the disclosed air register may also include the inner register assembly indicated generally by the reference character 34. The inner register is operative to admit combustion air from the wind box 12, substantially axially, and confines it in a funnel-like guide to provide a substantially straight stream of air that proceeds towards the burner and envelops the flame. In the preferred embodiment, the flow of air through the inner register is laminar.

Figure 7:
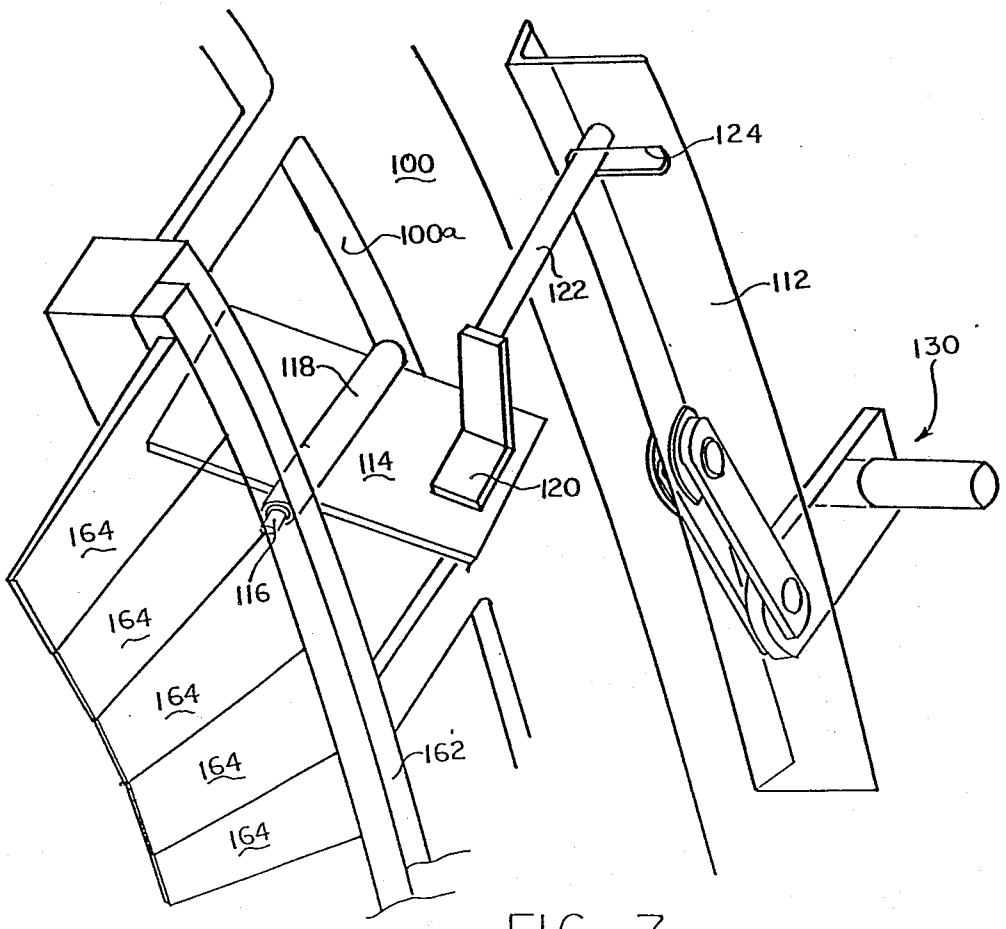
FIG. 7 is a fragmentary, perspective view of a linkage for operating axial damper doors forming part of the air register.

Referring also to FIGS. 1, 4, 6 and 8, the inner register includes an inlet ring 100 that is mounted to the outer mounting plate 32*a* of the outer register assembly. The inlet ring 100 defines a plurality of axial ports 100*a* through which combustion air is admitted into the inner register. The flow of air into the ports is controlled by a damper arrangement, indicated generally by the reference character 110 which includes a control ring 112. Referring also to FIG. 7, an inner damper door 114 is associated with each inlet port 100*a* and in particular, is pivotally supported in each port by a pivot pin 116. In the preferred and illustrated embodiment, each inner register damper door 114 is rectangular in configuration and is sized to substantially conform to its associated inlet port 100*a*. A pivot tube 118 is fixed as by welding to a central portion of the door 114 and is adapted to receive the pivot pin 116 which is mounted radially within each port. An L-shaped bracket 120 is welded to each damper door and defines a tab that extends outwardly from the door. An operating pin 122 extends from each operating tab and is received in an associated slot 124 formed in the control ring 112.

As shown best in FIG. 7, rotation of the control ring 112 produces concurrent opening and closing movement in the damper doors 114. A suitable linkage 130 which is remotely actuatable from outside the wind box 12 is used to produce rotative movement in the control ring 112 to open and close the inner damper doors 114.

As seen best in FIG. 6, the control ring 112 is rotatably supported by roller assemblies 130 fixed to the support plate 32a at spaced positions.

With the disclosed dual register construction, primary combustion air, admitted through the outer register can be independently adjustable from combustion air admitted through the inner register. Both registers can be adjusted from a fully closed to a fully opened position in order to provide precise adjustments in the flame intensity, flame length, ignition point, and other flame characteristics. In addition, turbulence induced in the combustion air can be precisely controlled in order to operate the burner at reduced emission levels. Unlike prior art daisy chain registers, the disclosed register can be adjusted to operate with reduced $NO_X$ emissions. The inner register reduces the need for adjustments to the fuel/air discharged by the fuel pipe assembly 20 to compensate for changes in combustion conditions. Instead the inner register can be used to make the required changes leaving the primary fuel/air flow unchanged. The disclosed operating linkages and mechanisms for both the outer register damper doors 42 and inner register damper doors 114 are reliable and easily maintained while at the same time providing remote actuation of the register (from outside the wind box 12).

A funnel shaped air guide 136 extends axially from the inlet ring 100 and directs the air inwardly towards the burner region 26. In addition, the funnel shaped air guide 136 defines a region of expanding cross section 68' for the outer register, when the inner register is used. As seen best in FIGS. 3 and 8, jack bolts 140 are mounted to a center support 142 and serve to support the fuel pipe to maintain its alignment with the center of the register. The center support 142 comprises a ring 144 that fits around a reduced diameter portion 136a of the air guide 136 and four radial stays 150 that extend radially from the ring 144 and are welded to the housing members 138. The jack bolts extend through the air guide portion 136a and about the periphery of the outer fuel pipe 22a.

The inner register inlet ring 100 is sealed to the outer fuel pipe 22a by a flexible air seal 160 which accommodates expansion and contraction of the fuel pipe due to temperature changes in the burner. Referring also to FIG. 7 the seal 160 comprises a mounting ring 162 to which are fastened a plurality of overlapping seal members 164. The seal members may be constructed of a resilient metal material to withstand the heat generated during operation of the burner. The members 164 extend radially from the mounting ring 162 and are preferably tapered in cross section in the radial direction. The disclosed configuration enables the members 164 to bend in order to accommodate expansion of the fuel pipe 22a while still maintaining a sealing engagement.

Although the invention has been described with a certain degree of particularity, it should be understood that those skilled in the art can make various changes to it without departing from the spirit or scope of the invention as hereinafter claimed.

I claim:

1. An air register for providing combustion air to a burner, comprising:

(a) an air register mounting frame comprising a pair of spaced apart support plates interconnected by circumferentially spaced, fixed housing members, said mounting frame defining an inlet opening for admitting combustion air between said fixed housing members;

(b) at least one, oblique non-planar, parallelogram-shaped, curved damper door pivotally mounted in said inlet opening for controlling the admission of combustion air into a region defined within said register, (c) each of said damper doors including a pair of parallel edges which define an oblique angle with respect to an axis of said register; and (d) pivot structure for pivotally mounting each of said damper doors, defining an axis of rotation for each door which extends substantially along a diagonal of said door.

2. An air register for providing combustion air to a burner, comprising:

(a) an air register mounting frame comprising a pair of spaced apart support plates interconnected by circumferentially spaced, fixed housing members, said mounting frame defining an inlet opening for admitting combustion air between said fixed housing members;

(b) at least one, oblique, non-planar, parallelogram-shaped, curved damper door pivotally mounted in said inlet opening for controlling the admission of combustion air into a region defined within said register;

(c) each of said damper doors including a pair of parallel edges which define an oblique angle with respect to an axis of said register;

(d) pivot structure for pivotally mounting each of said damper doors, defining an axis of rotation which extends substantially along a diagonal of said door; and, (e) a connector including turbulence control structure for reducing turbulence in the air admitted through said inlet for predetermined ranges of movement of said damper doors.

3. The air register of claim 2 wherein said connector further includes air leakage openings downstream of said turbulence control structure operative to inject air into said air flow that tends to counteract some turbulence.

4. The air register of claim 2 further comprising an inner register assembly defining a substantially axial flow path for combustion air commencing at an axial port means defined by circular array of apertures and a funnel-like guide member mounted within said mounting frame, terminating in an outlet near a combustion region.

5. The air register of claim 4 wherein a plurality of secondary damper doors control the admission of air through said circular array of apertures in said inner register.

6. The apparatus of claim 5 wherein said secondary damper doors are pivotally mounted within structure defining said apertures, said dampers being pivotally movable on pivot structure that defines pivot axes for said secondary doors that are substantially radial with respect to a center line of said air register.

7. A dual register for providing combustion air to a burner, comprising:

(a) an outer register portion comprising a frame member defining a plurality of peripheral openings for admitting combustion air radially with respect to a center line of said register;

(b) a plurality of outer damper doors associated with each opening, said damper doors movable between a closed position at which a minimal amount of combustion is admitted through said radial openings and a fully open position at which a maximum amount of combustion air is admitted into an inner region of said register;

(c) each of said damper doors comprising an oblique, non-planar, parallelogram-shaped member having an overall radius of curvature such that when said damper doors are positioned in a closed position, together they define a substantially uniform cylindrical surface;

(d) said damper doors configured such that for at least certain degrees of opening, said doors impart rotational and axial forces to said incoming air in order to cause said air to rotate and move towards a combustion region that is spaced axially from said peripheral openings;

(e) an inner register portion mounted within and coaxial aligned with said outer register portion, said inner register assembly comprising:

(i) an inlet member mounted to an outboard end of said outer register portion, said inlet member defining a plurality of inlet ports;

(ii) inner damper door means for adjusting an effective opening of said ports whereby the amount of air admitted into said inner register is controlled.

8. The apparatus of claim 7 wherein said ports in said inlet member define substantially axial openings and said inner damper door means comprise pivotally mounted doors associated with each aperture.

9. The apparatus of claim 8 wherein said inner doors are pivotally movable on an axis of rotation that is substantially radial with respect to a center line of said air register.

10. The apparatus of claim 7 further comprising a seal means mounted to said inlet member for sealingly engaging a fuel pipe assembly extending centrally through said register.

11. The apparatus of claim 10 wherein said seal means comprises a plurality of overlapping, flexible members extending radially inwardly from said inlet member such that portions of said seal members flexibly engage said fuel pipe assembly.

12. An air register for providing combustion air to a burner, comprising:

(a) structure defining a plurality of radial inlets, for admitting air into said register from a source of combustion air;

(b) said structure further defining a flow path for guiding a first stream of air from said inlet to a burner region;

(c) at least one pivotally mounted damper door mounted at each of said inlets for controlling the amount of air admitted through an associated inlet;

(d) connecting means for connecting said register to a combustion means;

(e) said connecting means defining a plurality of apertures for admitting a second stream of air from said combustion air source to a region near an outlet of said register, said second stream of air acting on said first stream of air to inhibit formation of undesirable flow patterns in said first stream of air as said first stream of air leaves said register.

13. The apparatus of claim 12 wherein each damper door is a non-planar, oblique parallelogram in configuration, and operates to impart axial as well as rotational movement to air entering said inlet.

14. The apparatus of claim 12 wherein said source of combustion air is a wind box.

15. The apparatus of claim 12 further comprising an inner register structure for providing a third stream of air to said burner region, said third stream of air being substantially axial in flow direction.

16. The apparatus of claim 15 wherein said inner register structure includes a plurality of axial openings and associated inner register damper doors, each inner damper door mounted for pivotal movement on a substantially radial axis with respect to a center line of said register.

17. The apparatus of claim 13 wherein said inner register structure includes a substantially funnel shaped air guide for guiding said third stream of air towards said burner region, said guide member arranged to provide a substantially laminar flow of air.

18. The apparatus of claim 15 further comprising a seal means for sealingly interconnecting said inner register structure with a fuel pipe means, said seal means including a mounting ring and a plurality of radially directed, overlapping sealing members extending inwardly from said inner register and engaging a periphery of said fuel pipe means.

19. The apparatus of claim 18 wherein said seal members are tapered in cross section in the radial direction.

20. An air register for providing combustion air to a burner, comprising:

(a) an air register mounting frame comprising a pair of spaced apart support plates interconnected by circumferentially spaced, fixed housing members, said mounting frame defining an inlet opening for admitting combustion air between said fixed housing members;

(b) at least one, oblique non-planar, parallelogram-shaped, curved damper door pivotally mounted in said inlet opening for controlling the admission of combustion air into a region defined within said register;

(c) each of said damper doors including a pair of parallel edges which define an oblique angle with respect to an axis of said register; and (d) pivot structure for pivotally mounting each of said damper doors, defining an axis of rotation for each door which extends substantially along a diagonal of said door, said door axes being substantially parallel to each other.

21. The apparatus of claim 20 wherein said door axes are substantially parallel to said register axis.

* * * * *